US009353770B2

(12) United States Patent
Fukumoto

(10) Patent No.: US 9,353,770 B2
(45) Date of Patent: May 31, 2016

(54) HYDRAULIC SYSTEM FOR A WORK VEHICLE

(75) Inventor: Toshiya Fukumoto, Takarazuka (JP)

(73) Assignee: Kubota Corporation, Osaka (JP)

( * ) Notice: Subject to any disclaimer, the term of this patent is extended or adjusted under 35 U.S.C. 154(b) by 906 days.

(21) Appl. No.: 13/389,570

(22) PCT Filed: Feb. 8, 2011

(86) PCT No.: PCT/JP2011/052642

§ 371 (c)(1),
(2), (4) Date: Apr. 26, 2012

(87) PCT Pub. No.: WO2011/122118

PCT Pub. Date: Oct. 6, 2011

(65) Prior Publication Data

US 2012/0198832 A1 Aug. 9, 2012

(30) Foreign Application Priority Data

Mar. 31, 2010 (JP) ..... 2010-083086

(51) Int. Cl.
*F15B 11/16* (2006.01)
*F15B 13/02* (2006.01)

(52) U.S. Cl.
CPC ..... *F15B 11/162* (2013.01); *F15B 13/024* (2013.01); *F15B 2211/30535* (2013.01); *F15B 2211/3111* (2013.01); *F15B 2211/4053* (2013.01); *F15B 2211/781* (2013.01)

(58) Field of Classification Search
CPC .... F15B 11/162; F15B 13/022; F15B 13/086; F15B 2211/30353; F15B 2211/6303; F15B 2211/6306; F15B 2211/6309; F15B 2211/6313; F15B 2211/632; F15B 2211/6323; F15B 2211/6326; F15B 2211/633; F15B 2211/6333; F15B 2211/6336; F15B 2211/634; F15B 2211/6343; F15B 2211/6346; F15B 2211/635; F15B 2211/6355; F15B 2211/63; F15B 2211/255; F15B 11/165; F15B 13/024; F15B 2211/781
USPC ..... 60/421, 422, 324
See application file for complete search history.

(56) References Cited

U.S. PATENT DOCUMENTS 3,952,509 A * 4/1976 Coleman ..... 60/422
4,759,183 A * 7/1988 Kreth et al. ..... 60/422

(Continued)

FOREIGN PATENT DOCUMENTS

DE 3821416 A1 12/1989
EP 1724233 A2 11/2006

(Continued)

*Primary Examiner* — Nathaniel Wiehe
*Assistant Examiner* — Abiy Teka
(74) *Attorney, Agent, or Firm* — The Webb Law Firm

(57) ABSTRACT

A hydraulic system for a work vehicle is disclosed. A preferential flow-dividing valve supplies a fixed amount of oil discharged from a variable displacement pump preferentially to a preferential hydraulic oil section and a surplus oil flow from the pump to a non-preferential hydraulic oil section. A plurality of electromagnetic proportional control valves are provided in the non-preferential hydraulic oil section for controlling oil flows relative to a plurality of hydraulically operated devices provided in the non-preferential hydraulic oil section. A necessary flow rate calculating module calculates a necessary oil flow rate in each of the preferential hydraulic oil section and the non-preferential hydraulic oil section based on a preferential oil flow rate of the preferential flow-dividing valve supplied to the preferential hydraulic oil section and an amount of current distributed to each of the plurality of electromagnetic proportional control valves in the non-preferential hydraulic oil section.

7 Claims, 10 Drawing Sheets

(56) References Cited

U.S. PATENT DOCUMENTS

| | | | | | |
|---|---|---|---|---|---|
| 4,966,066 | A | | 10/1990 | Kauss et al. | |
| 4,977,928 | A | * | 12/1990 | Smith et al. | 137/596 |
| 5,050,379 | A | * | 9/1991 | Nagai et al. | 60/368 |
| 5,127,227 | A | | 7/1992 | Ikari | |
| 5,758,499 | A | * | 6/1998 | Sugiyama et al. | 60/450 |
| 5,813,312 | A | * | 9/1998 | Arai et al. | 91/516 |
| 5,918,558 | A | * | 7/1999 | Susag | 111/200 |
| 6,047,545 | A | * | 4/2000 | Deininger | 60/426 |
| 6,173,573 | B1 | * | 1/2001 | Kamada | 60/422 |
| 6,176,083 | B1 | * | 1/2001 | Ikari | 60/422 |
| 6,422,121 | B1 | * | 7/2002 | Wysong | 91/356 |
| 7,143,579 | B2 | * | 12/2006 | Foster et al. | 60/446 |
| 7,222,484 | B1 | * | 5/2007 | Dornbach | 60/422 |
| 2003/0019681 | A1 | * | 1/2003 | Nakamura | 180/307 |
| 2003/0156949 | A1 | * | 8/2003 | Shimomura et al. | 417/213 |
| 2006/0235595 | A1 | * | 10/2006 | Sawada | 701/50 |
| 2006/0260301 | A1 | | 11/2006 | Yoshida et al. | |

FOREIGN PATENT DOCUMENTS

| | | | |
|---|---|---|---|
| JP | 58106203 | A | 6/1983 |
| JP | 5982004 | A | 5/1984 |
| JP | 6226587 | U | 2/1987 |
| JP | 1165766 | U | 11/1989 |
| JP | 2256902 | A | 10/1990 |
| JP | 2261912 | A | 10/1990 |
| JP | 5248404 | A | 9/1993 |
| JP | 2000085597 | A | 3/2000 |
| JP | 2001193701 | A | 7/2001 |

* cited by examiner

HYDRAULIC SYSTEM FOR A WORK VEHICLE

TECHNICAL FIELD OF THE INVENTION

The present invention relates to a hydraulic system for a work vehicle for supplying oil from a hydraulic pump operable with drive power from an engine to a plurality of hydraulically operated devices.

BACKGROUND OF THE INVENTION

An example of the above-noted hydraulic system for the work vehicle is disclosed in Japanese Unexamined Patent Application Publication No. 2000-085597 (JP 2000-085597 A) (Patent Document 1) With this hydraulic system, in a steering operation, the entire amount of oil from a fixed displacement hydraulic pump actuated by drive power from the engine is supplied preferentially to a hydraulically operated power steering device. In a non-power steering operation, on the other hand, oil from the hydraulic pump is supplied preferentially through a preferential flow-dividing valve to a hydraulically operated elevation actuating device for vertically moving a work implement (e.g. elevation control valve and lift cylinder) and a hydraulically operated rolling actuating device for rolling and actuating the work implement (e.g. rolling control valve and rolling cylinder).

Since the fixed displacement pump is used for the hydraulic pump in such a conventional hydraulic system, a discharge rate of the hydraulic pump when actuating at low rotational speed is set to a great value in order to secure an oil flow rate required for actuating the power steering device and an oil flow rate required for actuating the elevation actuating device and the rolling actuating device even when the rotational speed of the engine is low. Therefore, when the rotational speed of the engine is increased, an amount of oil more than necessary is supplied to the power steering device, etc. This results in waste of energy and increased oil temperature. Thus, there is room for improvement from the viewpoint of saving energy.

In addition, since the elevation actuating device cannot be operated during the power steering operation, the steering operation and the elevation operation of the work implement cannot be concurrently performed, such as raising the work implement when starting a turn for executing the steering operation or lowering the work implement when finishing the turn, in order to make a turn in a verge of a ridge during a cultivating operation with a rotary tiller being connected to a rear portion of the work vehicle. Thus, there is room for improvement in operability.

Further, when the elevation actuating device and the rolling actuating device are concurrently actuated, oil is supplied preferentially to the rolling actuating device under the action of the preferential flow-dividing valve, which might cause a retarded operation of the elevation actuating device. In order to avoid such an inconvenience, it is necessary to increase the discharge rate of the hydraulic pump, which makes it further difficult to save energy.

PRIOR ART DOCUMENT(S)

Patent Document(s)

Patent Document 1: Japanese Unexamined Patent Application Publication No. 2000-085597 (JP 2000-085597 A)

SUMMARY OF INVENTION

Problem(s) to be Solved by the Invention

For the above-noted reasons, a system is desired for improving the operability and allowing a plurality of hydraulically operated devices to be concurrently actuated satisfactorily while saving energy.

Means for Solving the Problem(s)

The above-noted object is fulfilled by a hydraulic system for a work vehicle according to the present invention, as under:

A hydraulic system for a work vehicle, comprising:

a variable displacement pump operable with drive power form an engine;

an actuator for regulating a discharge rate of the variable displacement pump;

a preferential flow-dividing valve for supplying a fixed amount of oil discharged from the variable displacement pump preferentially to a preferential hydraulic oil section and supplying a surplus oil flow from the pump to a non-preferential hydraulic oil section;

a plurality of electromagnetic proportional control valves provided in the non-preferential hydraulic oil section for controlling oil flows relative to a plurality of hydraulically operated devices included in the non-preferential hydraulic oil section, the plurality of electromagnetic proportional control valves including a high priority electromagnetic proportional control valve and a low priority electromagnetic proportional control valve;

a second preferential flow-dividing valve for supplying a preferential oil flow to the plurality of the high priority electromagnetic proportional control valve, and supplying a surplus oil flow of the preferential oil to the low priority electromagnetic proportional control valve;

a necessary flow rate calculating module for calculating a necessary oil flow rate in each of the preferential hydraulic oil section and the non-preferential hydraulic oil section based on a preferential oil flow rate of the preferential flow-dividing valve supplied oil to the preferential hydraulic oil section and an amount of current distributed to each of the plurality of electromagnetic proportional control valves in the non-preferential hydraulic oil section;

correlation data showing relationship among the discharge rate of the variable displacement pump, a rotational speed of the engine and an operational amount of the actuator;

a target operational amount setting module for providing a control target operational amount of the actuator for obtaining the necessary oil flow rate calculated at the necessary flow rate calculating module based on the necessary oil flow rate calculated at the necessary flow rate calculating module, an output from a rotary sensor for detecting the rotational speed of the engine, and the correlation data; and an operation control module for controlling the actuator based on the control target operational amount.

With the above arrangement, when the plurality of hydraulically operated devices provided in the non-preferential hydraulic oil section are not be actuated, the discharge rate of the variable displacement pump corresponds to only a fixed amount of oil supplied to the preferential hydraulic oil section (oil flow rate required at the preferential hydraulic oil section), which prevents wasteful discharge.

On the other hand, when any one(s) of the plurality of hydraulically operated devices provided in the non-preferential hydraulic oil section is actuated, the discharge rate of the variable displacement pump corresponds to the fixed amount of oil supplied to the preferential hydraulic oil section added by an oil flow rate required in actuating the hydraulically operated device(s) to be actuated, which also prevents wasteful discharge.

To each of the hydraulically operated devices to be actuated in the preferential hydraulic oil section and the non-preferential hydraulic oil section can be distributed the necessary flow rate of oil under the action of each preferential flow-dividing valve. This allows simultaneous actuation of the hydraulically operated device provided in the preferential hydraulic oil section and the hydraulically operated device provided in the non-preferential hydraulic oil section, and simultaneous actuation of the plurality of hydraulically operated devices provided in the non-preferential hydraulic oil section.

As a result, it is possible to improve the operability and actuate the plurality of hydraulically operated devices satisfactorily while saving energy.

In one preferable embodiment of the present invention, the target operational amount setting module is configured to obtain a volume efficiency of the variable displacement pump based on an output from an oil temperature sensor for detecting a temperature of oil and an output from a pressure sensor for detecting discharge pressure of the variable displacement pump, and to correct the control target operational amount of the actuator based on the obtained volume efficiency.

With the above arrangement, it is possible to reliably supply the necessary flow rate of oil to each of the hydraulically operated devices to be actuated in the preferential hydraulic oil section and the non-preferential hydraulic oil section, regardless of variations of the volume efficiency of the variable displacement pump caused by the oil temperature.

Another preferable embodiment of the present invention further comprises an oil pressure detecting module for detecting pressure of oil supplied to the most downstream electromagnetic proportional control valve, wherein the target operational amount setting module is configured to correct the control target operational amount of the actuator to allow the pressure of oil supplied to the most downstream electromagnetic proportional control valve to reach a predetermined pressure based on an output from the oil pressure detecting module.

With the above arrangement, it is possible to regulate the discharge rate of the variable displacement pump so that oil pressure may constantly reach the predetermined pressure, thereby to reliably supply the necessary flow rate of oil to each of the hydraulically operated devices to be actuated in the preferential hydraulic oil section and the non-preferential hydraulic oil section.

In a further preferable embodiment of the present invention:

the second preferential flow-dividing valve provided in the non-preferential hydraulic oil section is a variable preferential flow-dividing valve, the second preferential flow-dividing valve provided in the non-preferential hydraulic oil section is a variable preferential flow-dividing valve;

a plurality of the high priority electromagnetic proportional control valves are provided in the non-preferential hydraulic oil section, each of the high priority electromagnetic proportional control valves comprises a closed-center type valve, and wherein each of the electromagnetic proportional control valves forms a hydraulic unit which comprises a closed load-sensing type hydraulic unit for regulating the preferential flow rate of the variable preferential flow-dividing valve based on load-sensing pressure.

With the above arrangement, when any one or more of the plurality of high priority electromagnetic proportional control valves provided in the non-preferential hydraulic oil section is/are operated to actuate the corresponding hydraulically operated device(s), it is possible to properly adjust the preferential flow rate of the variable preferential flow-dividing valve to the oil flow rate that is necessary for actuating the corresponding hydraulically operated device(s) based on the load-sensing pressure at that time.

BRIEF DESCRIPTION OF THE DRAWING(S)

EMBODIMENT(S) OF THE INVENTION

An embodiment of the present invention will be described hereinafter with reference to the drawings accompanied therewith. In this embodiment, a hydraulic unit for a work vehicle according to the present invention is applied to a tractor, an example of the work vehicle.

Figure 1:
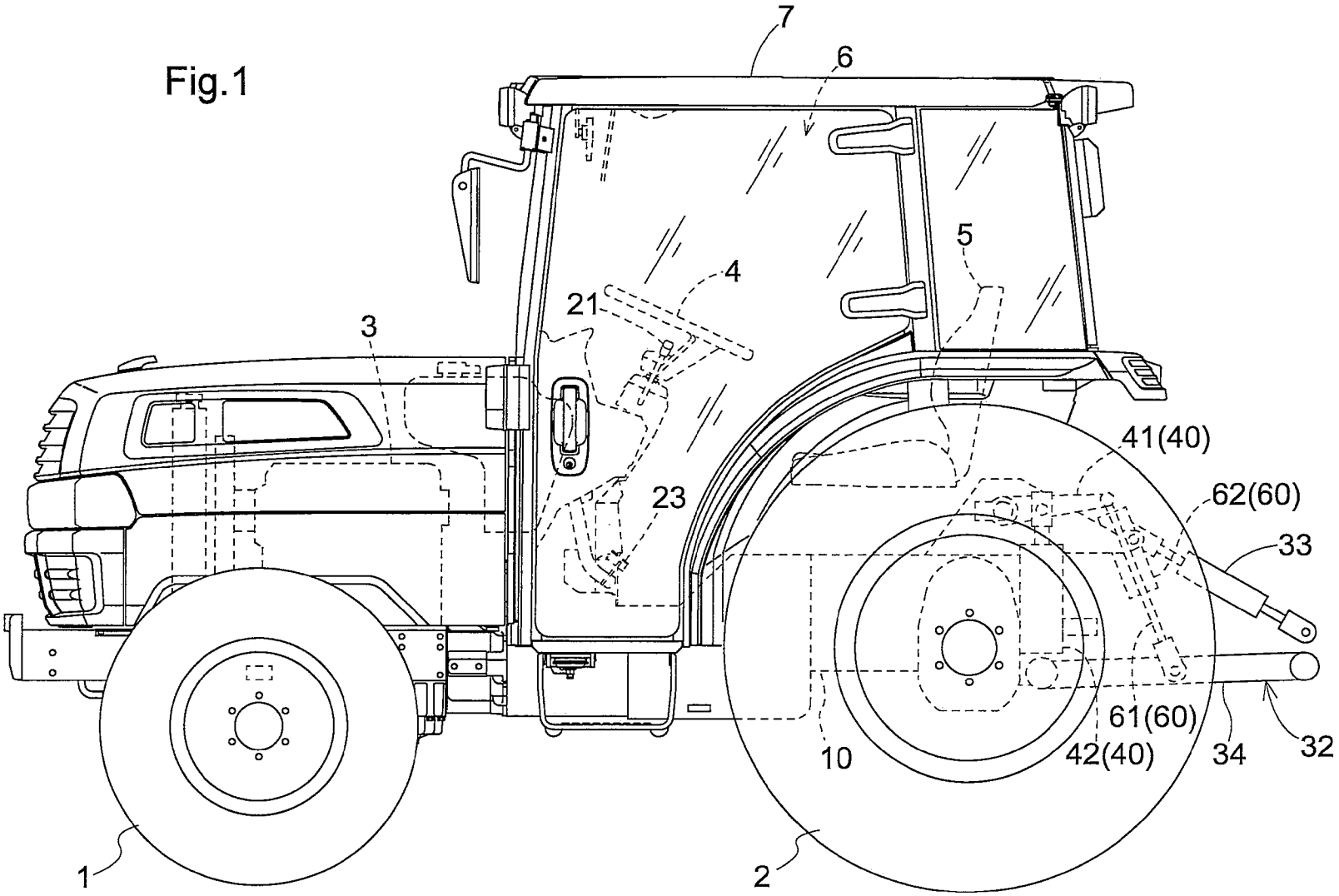
FIG. 1 is an overall left side view of a tractor.

As shown in FIG. 1, the tractor in the illustrated embodiment is a four-wheel drive type tractor including a pair of right and left steerable and driven front wheels 1 and a pair of right and left driven rear wheels 2. A water cooled type diesel engine (referred to as "engine" hereinafter) 3 and other components are mounted on a front half portion of the tractor. On a rear half portion of the tractor, a driver's section 6 is formed to have a steering wheel 4 for steering the front wheels and a driver's seat 5, etc. therein, and a cabin 7 is provided for covering the driver's section 6.

Figure 2:
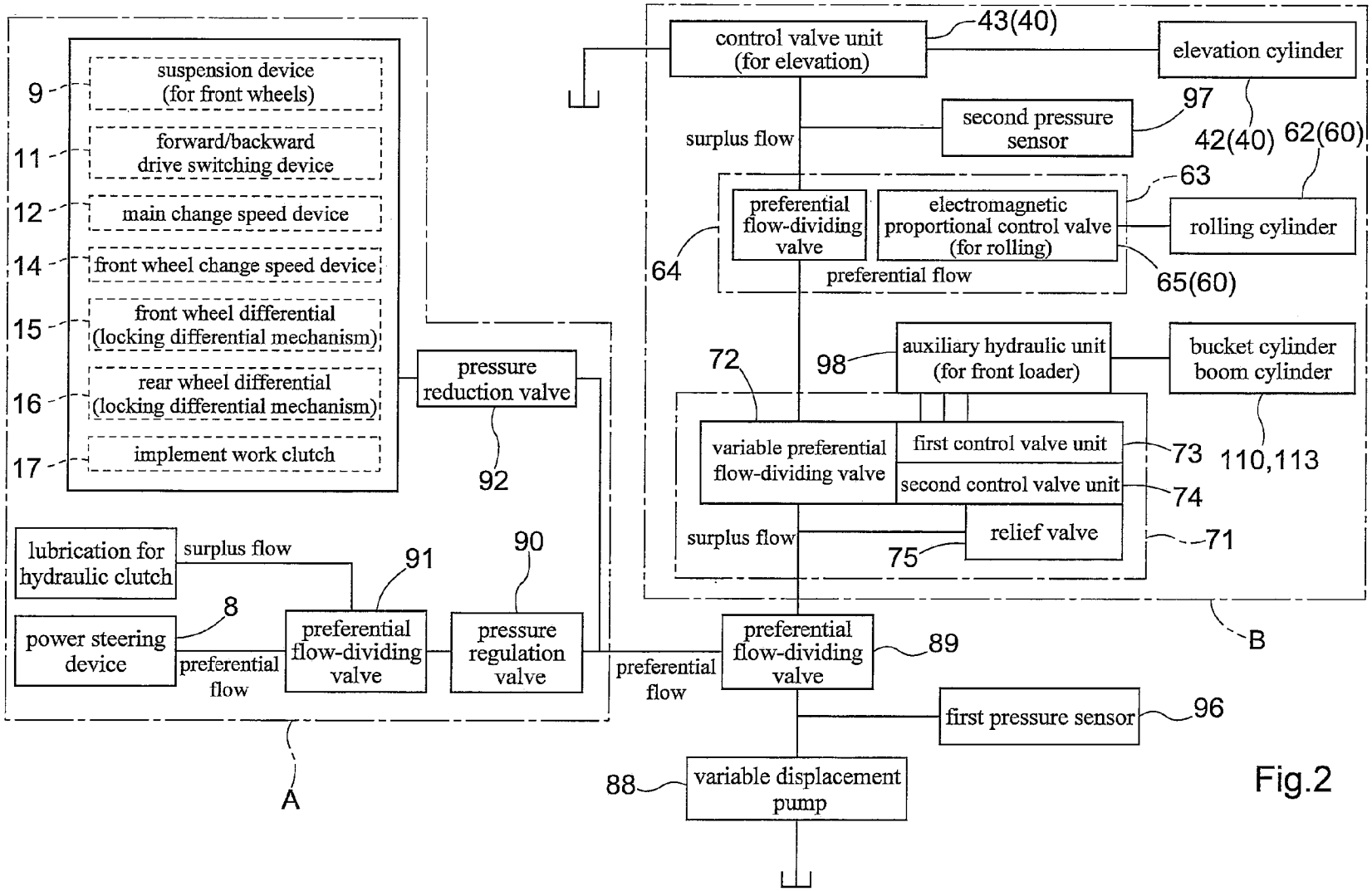
FIG. 2 is a diagram showing a hydraulic system of the tractor.
Figure 3:
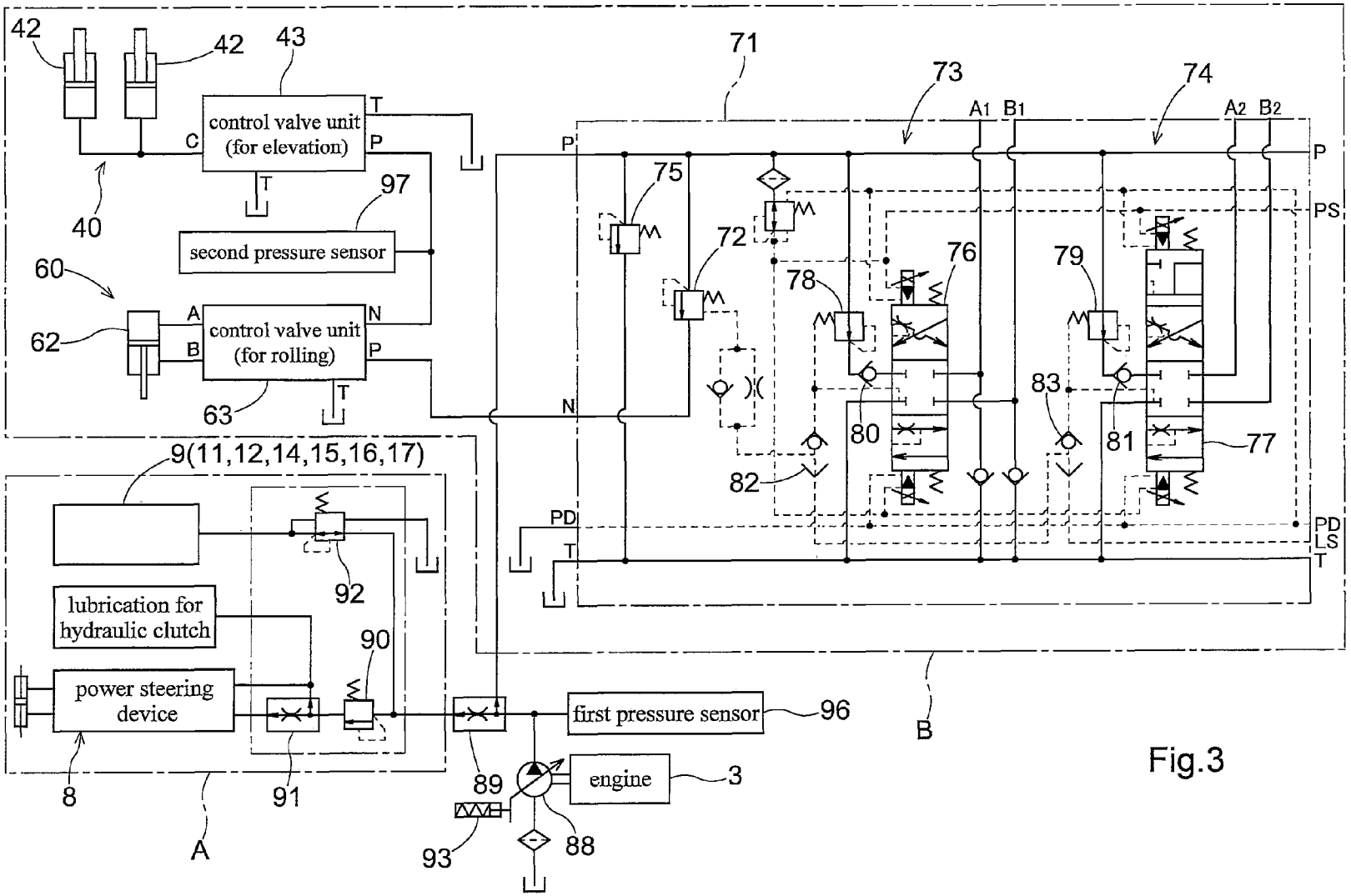
FIG. 3 is a schematic view of a hydraulic circuit of the tractor.

As shown in FIGS. 2 and 3, the tractor further includes a hydraulic type power steering device 8. More particularly, the steering wheel 4 is linked to the right and left front wheels 1 through the power steering device 8, etc. The tractor still further includes a hydraulic type front wheel suspension device 9.

Figure 4:
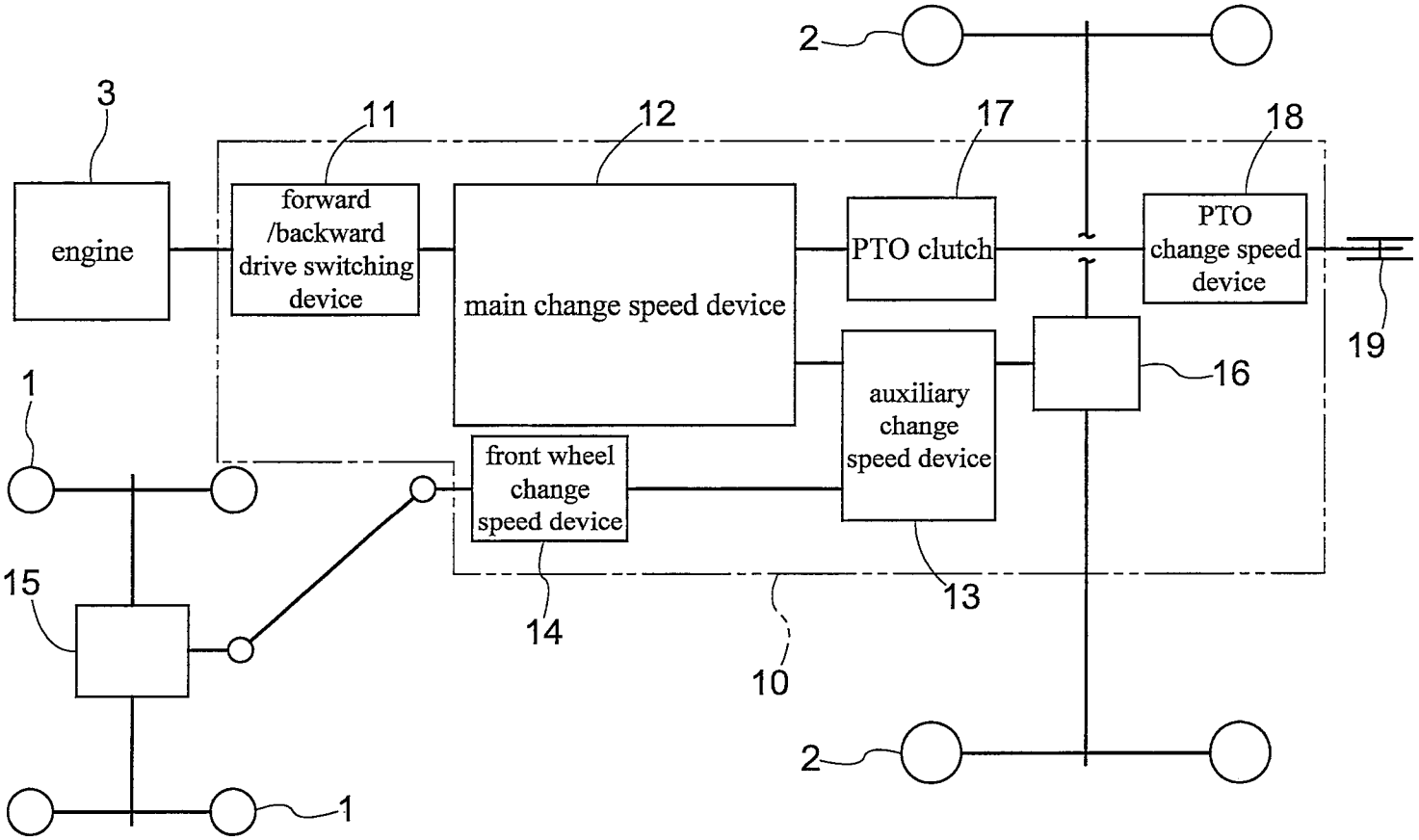
FIG. 4 is a diagram showing a transmission system of the tractor.
Figure 5:
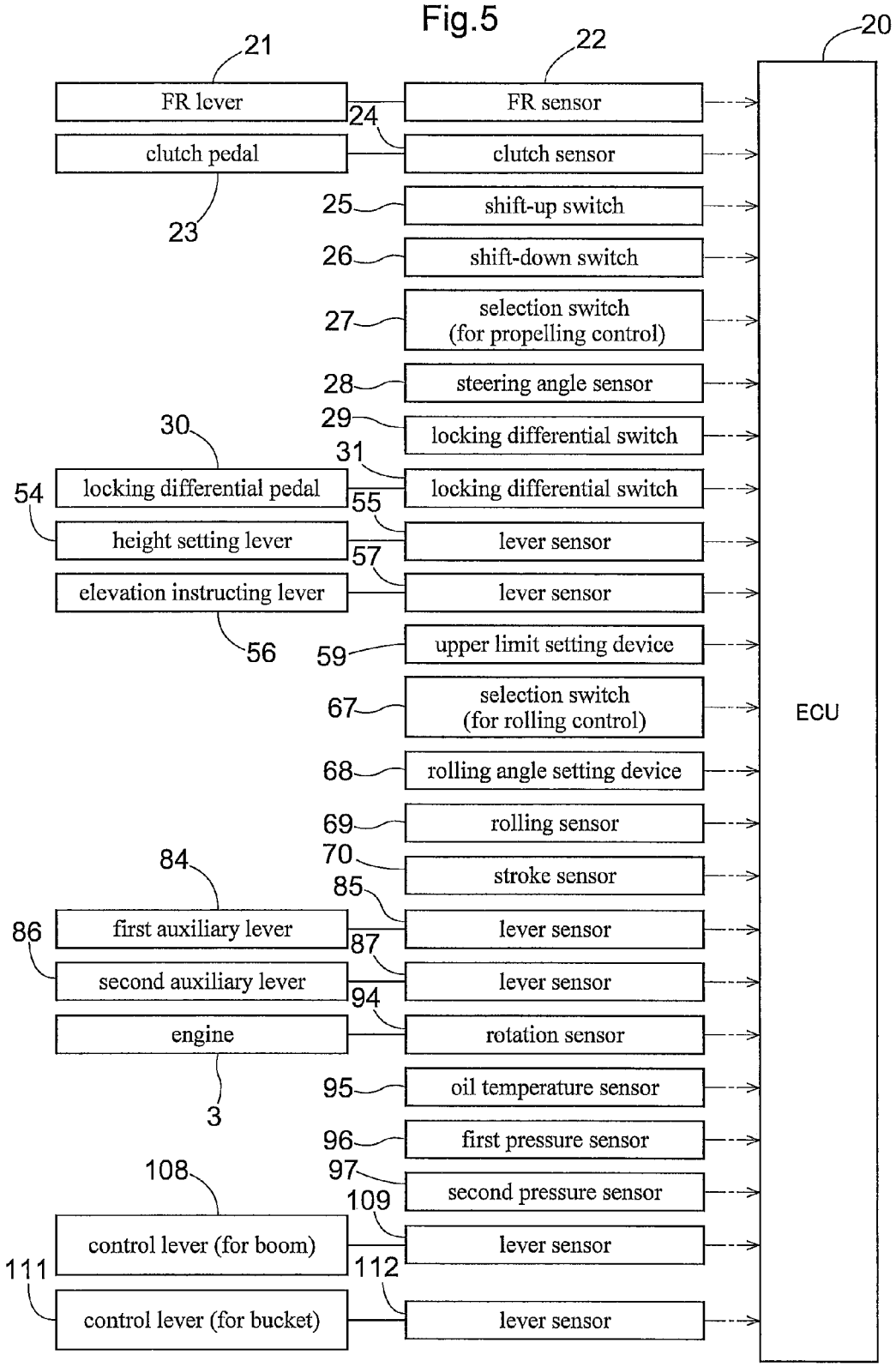
FIG. 5 is a diagram showing a portion of a control system of the tractor.
Figure 6:
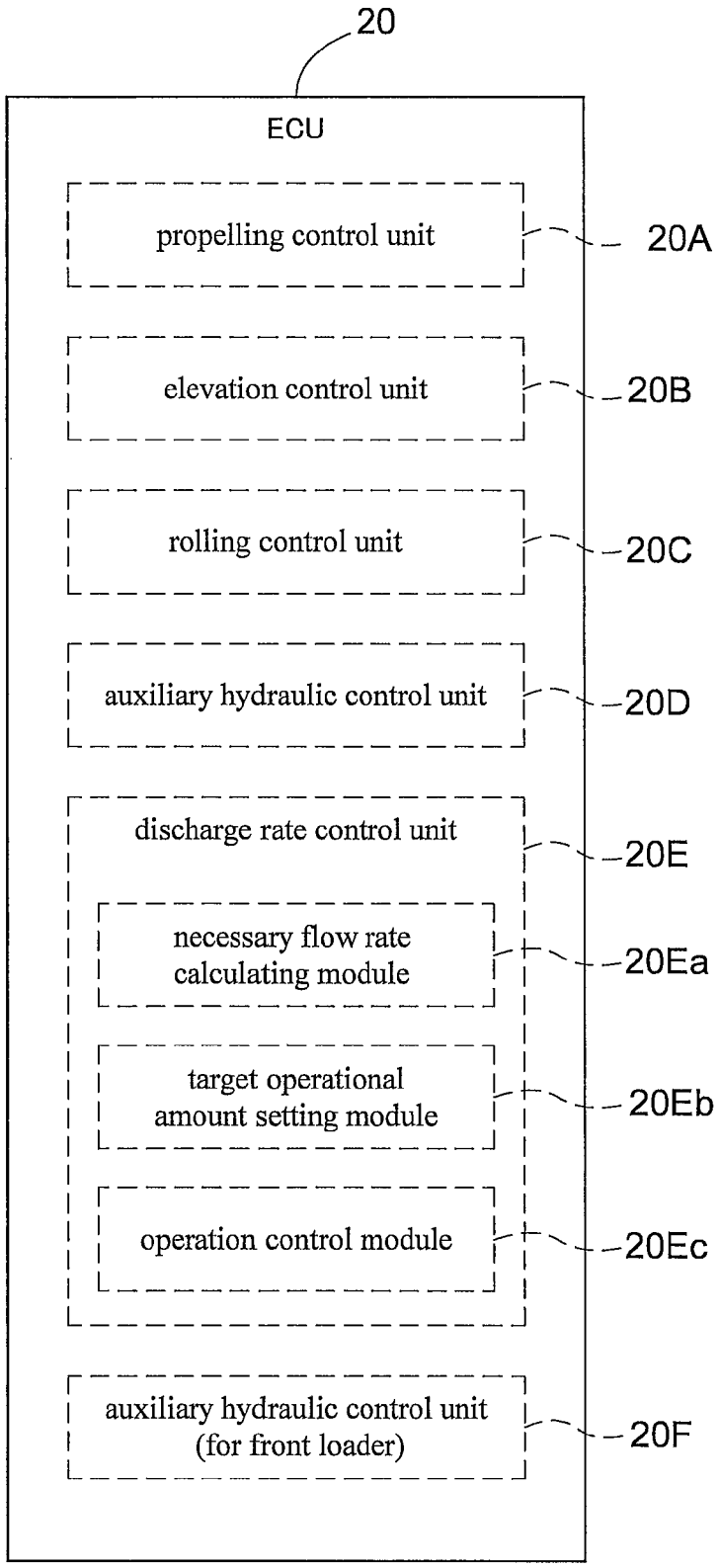
FIG. 6 is a diagram showing another portion of the control system of the tractor.
Figure 7:
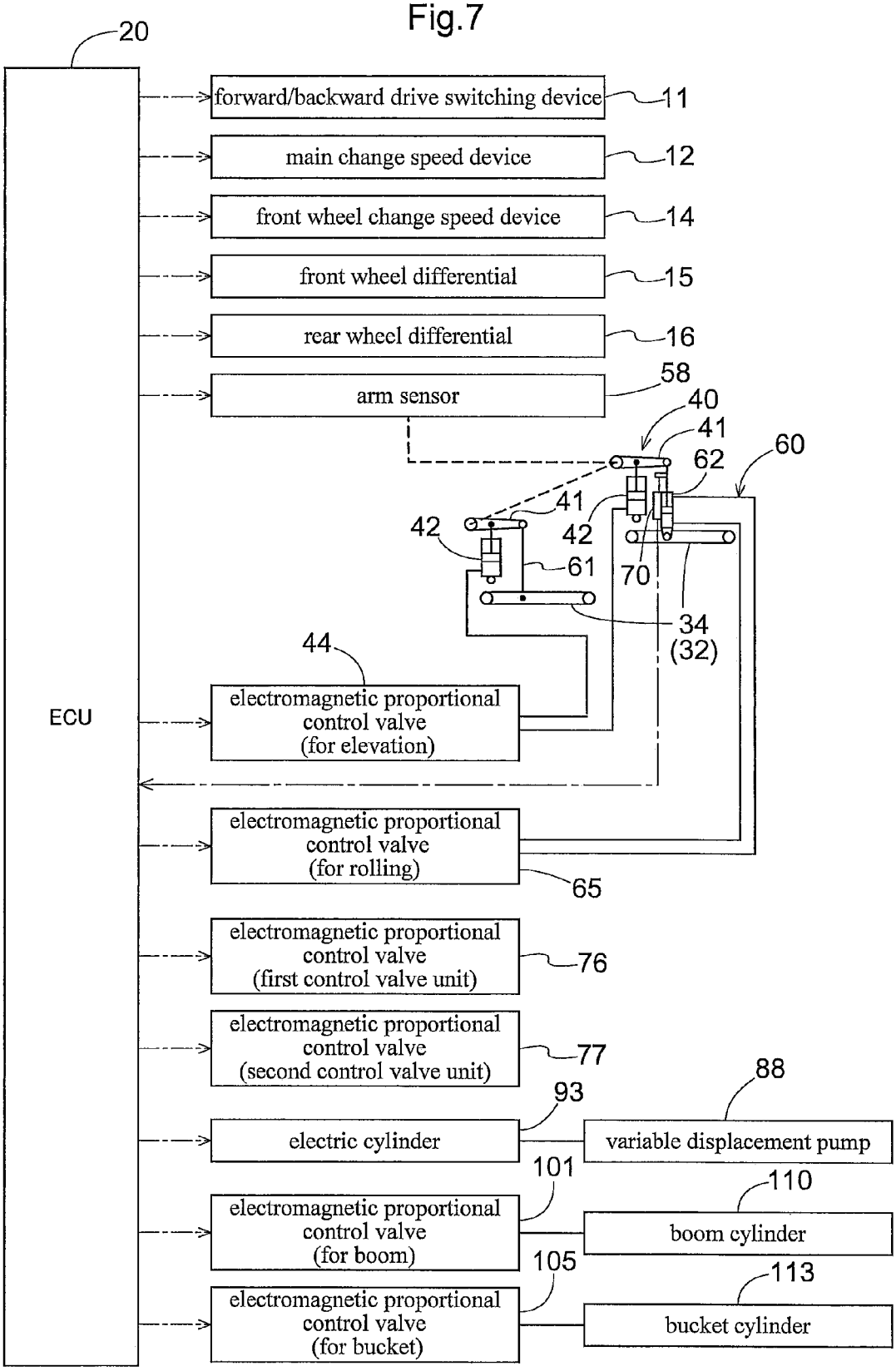
FIG. 7 is a diagram showing still another portion of the control system of the tractor.

As shown in FIG. 4, drive power outputted from the engine 3 is supplied to an interior of a transmission case 10. Then, the drive power is divided into propelling power and implement work power by a double-shaft structure in the interior of the transmission case 10. The propelling power is transmitted to a forward/backward drive switching device 11 that also acts as a propelling clutch, a main change speed device 12, and an auxiliary change speed device 13. Then, the drive power outputted from the auxiliary change speed device 13 is divided into power for driving the front wheels and power for driving the rear wheels. The power for driving the front wheels is transmitted to the right and left front wheels 1 through a front wheel change speed device 14 and a front wheel differential 15, etc. The power for driving the rear wheels is transmitted to the right and left rear wheels 2 through a rear wheel differential 16, etc. The implement work power is transmitted to a PTO shaft 19 for power takeoff (PTO) through an implement work clutch 17 and an implement work change speed device (PTO change speed device) 18, etc.

Although not shown, the forward/backward drive switching device 11 is formed as a hydraulic type device which is switchable, by actuating a hydraulic unit provided in the forward/backward drive switching device 11, to one of a cutoff mode for breaking the power transmission from the engine 3 to the main change speed device 12, a forward drive transmission mode for transmitting the power from the engine 3 to the main change speed device 12 as forward drive power, and a backward drive transmission mode for transmitting the power from the engine 3 to the main change speed device 12 as backward drive power. The hydraulic unit of the forward/backward drive switching device 11 includes two hydraulic clutches, one for establishing and breaking the forward drive power transmission and the other for establishing and breaking the backward drive power transmission; two pilot-operated switching valves, each for switching over an oil flow relative to the hydraulic clutch associated therewith; two electromagnetic on/off valves, each for controlling pilot pressure relative to the switching valve associated therewith; and an electromagnetic proportional reduction valve for controlling clutch pressure of the respective hydraulic clutches, etc.

The main change speed device 12 is designed as a hydraulic type device which is switchable, by actuating a main change speed hydraulic unit provided in the main change speed device 12, to one of eight speeds obtained by combinations of four speeds and high/low two speeds. The main change speed hydraulic unit includes four hydraulic clutches for the respective four speeds; two hydraulic clutches for the respective high/low speeds; four pilot-operated switching valves, each for switching over an oil flow relative to the hydraulic clutch for one of the four speeds associated therewith; four electromagnetic on/off valves, each for controlling pilot pressure relative to the switching valve associated therewith; and two electromagnetic proportional reduction valves for controlling clutch pressure of the hydraulic clutch for one of the high/low speeds associated therewith, etc.

The auxiliary change speed device 13 is designed as a synchromesh type device which is switchable to one of the two high/low speeds by sliding a sleeve provided in the auxiliary change speed device 13. The sleeve is linked to a propelling shift lever provided in the driver's section 6 through an auxiliary change speed mechanical linkage. The propelling shift lever is selectively operable to one of three positions, i.e. a low speed position, a neutral position and a high speed position, and held at that position.

The front wheel change speed device 14 is designed as a hydraulic type which is switchable, by actuating a front wheel change speed hydraulic unit provided in the front wheel change speed device 14, to one of cutoff mode for breaking the power transmission to the right and left front wheels 1, an equal-speed drive mode in which peripheral speeds of the right and left front wheels 1 are equal to peripheral speeds of the right and left rear wheels 2, and an increased speed drive mode in which the peripheral speeds of the right and left front wheels 1 are multiplied by 1.6 times of the peripheral speeds of the right and left rear wheels 2. The front wheel change speed unit includes two clutches, one for establishing and breaking the equal-speed drive power and the other for establishing and breaking the increased speed drive power; two pilot-operated switching valves, each for switching over an oil flow relative to the hydraulic clutch associated therewith; and two electromagnetic on/off valves, each for controlling pilot pressure relative to the switching valve associated therewith, etc.

The front wheel differential 15 includes a hydraulic type locking differential mechanism. The locking differential mechanism includes a hydraulic clutch for switching the front wheel differential 15 to one of a differential permitting mode and a differential prohibiting mode; a pilot-operated switching valve for switching over an oil flow relative to the hydraulic clutch; and an electromagnetic on/off valve for controlling pilot pressure relative to the switching valve, etc.

The rear wheel differential 16 includes a hydraulic type locking differential mechanism. The locking differential mechanism includes a hydraulic clutch for switching the rear wheel differential 16 to one of a differential permitting mode and a differential prohibiting mode; a pilot-operated switching valve for switching over an oil flow relative to the hydraulic clutch; and an electromagnetic on/off valve for controlling pilot pressure relative to the switching valve, etc.

The implement work clutch 17 comprises a hydraulic clutch. The implement work clutch 17 is configured to establish and break the power transmission from the engine 3 to the implement work change speed device 18 by actuating the switching valve, etc. for switching over an oil flow relative to the implement work clutch 17. The switching valve is linked to a clutch lever provided in the driver's section 6 through an implement work clutch mechanical linkage. The clutch lever is selectively switched to one of two positions, i.e. an engaged position and a disengaged position, and held at that position.

The implement work change speed device 18 is designed as a synchromesh type device which is switchable to one of two high/low speeds by actuating a sleeve provided in the implement work change speed device 18. The sleeve is linked to an implement work shift lever provided in the driver's section 6 through an implement work change speed mechanical linkage. The implement work shift lever is selectively switched to one of two positions, i.e. a low speed position and a high speed position.

As shown in FIGS. 5 to 8, an electronic control unit (referred to as "ECU" or "controller" hereinafter) 20 is mounted on the tractor. The ECU 20 is designed to use a microcomputer having a CPU (Central Processing Unit) and EEPROM (Electrically Erasable and Programmable Read Only Memory).

The ECU 20 is loaded with a propelling control unit 20A as a control program for controlling operations of the forward/backward drive switching device 11, the main change speed device 12, the front wheel change speed device 14, the front wheel differential 15, the rear wheel differential 16, etc.

The propelling control unit 20A is configured to perform forward/backward drive switching control for switching the operating state of the forward/backward switching device 11, based on output from an FR sensor 22 which detects an operational position of an FR lever 21 which is operable to switch over the forward/backward drive. When the FR sensor 22 detects that the FR lever 21 is operated to a forward drive position of the FR lever 21, the forward/backward drive switching control is performed to control the operations of the two electromagnetic on/off valve and the electromagnetic proportional reduction valve provided in the forward/backward drive switching device 11 in order to establish the forward drive transmission state of the forward/backward drive switching device 11. On the other hand, when the FR sensor 22 detects that the FR lever 21 is operated to a backward drive position of the FR lever 21, the forward/backward drive switching control is performed to control the operations of the two electromagnetic on/off valve and the electromagnetic proportional reduction valve provided in the forward/backward drive switching device 11 in order to establish the backward drive transmission state of the forward/backward drive switching device 11. When the FR sensor 22 does not detect an operation of the FR lever 21 to the forward drive position or the backward drive position, the forward/backward drive switching control is performed to control the operations of the two electromagnetic on/off valve and the electromagnetic proportional reduction valve provided in the forward/backward drive switching device in order to establish the transmission cutoff state of the forward/backward drive switching device 11.

The FR lever 21 is provided in the driver's section 6 to be selectively switchable to one of two positions, i.e., a forward drive position and a backward drive position and held at that position. The FR sensor 22 is formed by a microswitch for detecting the forward drive position and a microswitch for detecting the backward drive position.

The propelling control unit 20A is configured to perform clutch control for controlling the clutch pressure of the hydraulic clutches provided in the forward/backward drive switching device 11 for establishing and breaking the forward drive power transmission and for establishing and breaking the backward drive power transmission, respectively, based on output from a clutch sensor 24 for detecting an amount of depression of a clutch pedal 23. The clutch control is performed to control the operation of the electromagnetic proportional reduction valve provided in the forward/backward drive switching device 11 so that proper clutch pressure is obtained depending on the amount of depression of the clutch pedal 23 detected by the clutch sensor 24.

The clutch pedal 23 is mounted on the driver's section 6 and configured to automatically return to a depression-releasing position. A rotary potentiometer is used for the clutch sensor 24.

The propelling control unit 20A performs change-speed control for shifting the speed of the main change speed device 12 based on change-speed instructions outputted from a shift-up switch 25 and a shift-down switch 26 provided in the propelling shift lever. When a shift-up instruction is received from the shift-up switch 25, the change-speed control is performed to control the operations of the four electromagnetic on/off valves and the two electromagnetic proportional reduction valves provided in the main change speed device 12 in order to shift the speed of the main change speed device 12 to a higher speed. On the other hand, when a shift-down instruction is received from the shift-down switch 26, the change-speed control is performed to control the operations of the four electromagnetic on/off valves and the two electromagnetic proportional reduction valves provided in the main change speed device 12 in order to shift the speed of the main change speed device 12 to a lower speed. Momentary switches are used for the shift-up switch 25 and the shift-down switch 26.

The propelling control unit 20A is switchable to one of a mode for performing first front wheel change-speed control, a mode for performing second front wheel change-speed control and a mode for performing third front wheel change-speed control relative to the front wheel change speed device 14 based on a switching instruction outputted from a select switch 27 for propelling control provided in the driver's section 6.

In the first front wheel change-speed control, the operations of the two electromagnetic on/off valves provided in the front wheel change speed device 14 are controlled to achieve the cutoff state of the front wheel change speed device 14, thereby to switch the drive mode of the tractor to a two-wheel drive mode.

In the second front wheel change-speed control, the operations of the two electromagnetic on/off valves provided in the front wheel change speed device 14 are controlled to achieve the equal-speed transmission state of the front wheel change speed device 14, thereby to switch the drive mode of the tractor to a four-wheel drive mode.

In the third front wheel change-speed control, a steering angle of the front wheel 1 positioned in the inside of the turn is determined based on an output from a steering-angle sensor 28. If the steering angle of the front wheels 1 in the inside of the turn is less than a predetermined angle, the operations of the two electromagnetic on/off valves provided in the front wheel change speed device 14 are controlled so that the equal-speed transmission state of the front wheel change speed device 14 is achieved, thereby to switch the drive mode of the tractor to the four-wheel drive mode. On the other hand, if the steering angle of the front wheels 1 in the inside of the turn is the predetermined angle or above, the operations of the two electromagnetic on/off valves provided in the front wheel change speed device 14 are controlled so that the increased speed transmission state of the front wheel change speed device 14 is achieved, thereby to switch the drive mode of the tractor to a front wheel increased speed mode.

A momentary switch is used for the select switch 27. A rotary potentiometer is used for the steering-angle sensor 28 for detecting a sideways swinging angle of a pitman arm (not shown) as the steering angle of the front wheel 1 positioned in the inside of the turn.

The propelling control unit 20A performs front wheel differential switching control for switching the operational state of the front wheel differential device 15 based on an output from a locking differential switch 29 provided in the driver's section 6. In the front wheel differential switching control, if there is no output from the locking differential switch 29, the operation of the electromagnetic on/off valve provided in the front wheel differential device 15 is controlled so that the differential permitting state of the front wheel differential device 15 is achieved. On the other hand, if there is an output from the locking differential switch 29, the operation of the electromagnetic on/off valve provided in the front wheel differential device 15 is controlled so that the differential prohibiting state of the front wheel differential device 15 is achieved. A momentary switch is used for the locking differential switch 29.

The propelling control unit 20A performs rear wheel differential switching control for switching the operational state of the rear wheel differential device 16 based on an output from a locking differential switch 31 for detecting an operational position of a locking differential pedal 30. In the rear wheel differential switching control, if there is no output from the locking differential switch 31, the operation of the electromagnetic on/off valve provided in the rear wheel differential device 16 is controlled so that the differential permitting state of the rear wheel differential device 16 is achieved. On the other hand, if there is an output from the locking differential switch 31, the operation of the electromagnetic on/off valve provided in the rear wheel differential device 16 is controlled so that the differential prohibiting state of the rear wheel differential device 16 is achieved.

The locking differential pedal 30 is selectively switched to one of two positions, i.e. a depression-releasing position and a depression position, and held at that position. The locking differential pedal 30 is mounted on the driver's section 6. The locking differential switch 31 is a momentary switch.

As shown in FIG. 1 and FIGS. 5 to 8, a link mechanism 32 is mounted on a rear portion of the transmission case for connecting a work implement. The link mechanism 32 includes an upper link 33 and right and left lower links 34 that are connected to the rear portion of the transmission case 10 to be vertically swingable.

As shown in FIGS. 1 to 3 and FIGS. 5 to 8, the tractor includes an elevation actuating device 40 for vertically moving the work implement (not shown) such as a rotary tiller or plough connected to a rear portion of the tractor though the link mechanism 32. The elevation actuating device 40 is a hydraulic type device including right and left lift arms 41 that are vertically oscillatable for vertically moving the work implement, right and left elevation cylinders (an example of the hydraulically operated device) 42 for oscillating the right and left lift arms 41, and an elevation control valve unit 43 for controlling an oil flow relative to the right and left elevation cylinders 42, etc. Single-acting cylinders are used for the right and left elevation cylinders 42.

Figure 9:
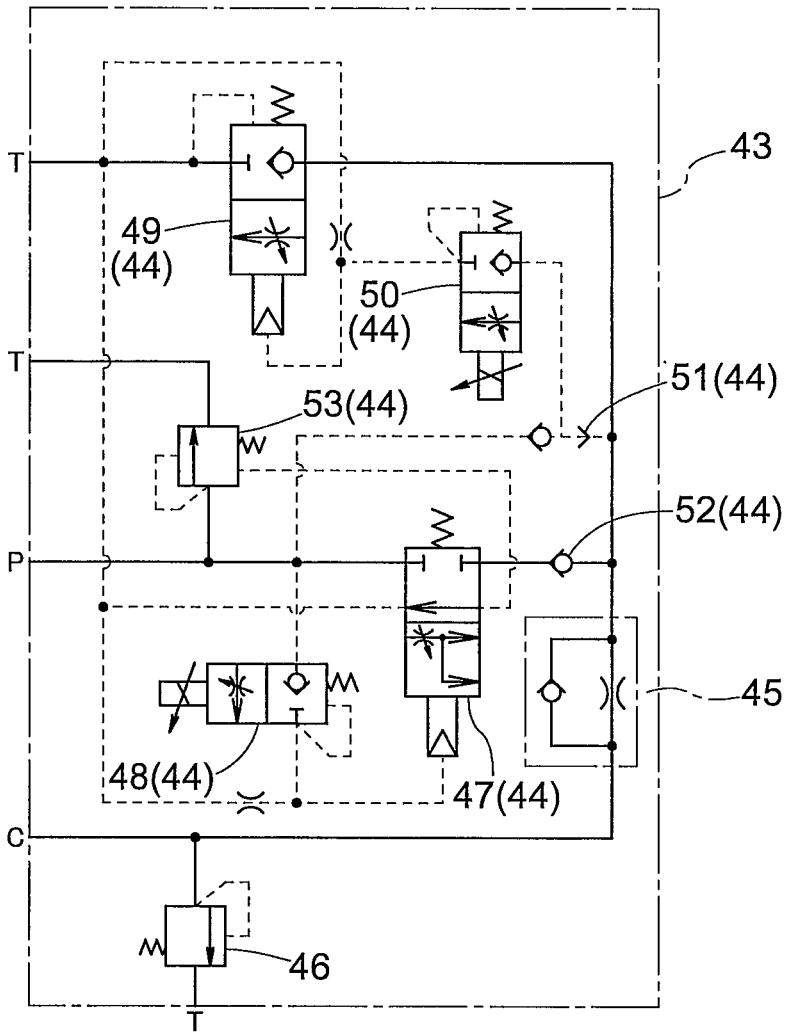
FIG. 9 is a hydraulic circuit showing architecture of an elevation control valve unit.

As shown in FIG. 9, the elevation control valve unit 43 includes a vertical movement electromagnetic proportional control valve 44, a descent adjustment valve 45 for regulating the speed of lowering the right and left lift arms (work implement) 41, and a relief valve 46, etc. The vertical movement electromagnetic proportional control valve 44 is a pilot-operated type valve including a raising proportional valve 47 for controlling an oil flow rate on a raising side, a raising electromagnetic pilot valve 48 for controlling pilot pressure relative to the raising proportional valve 47, a lowering proportional valve 49 for controlling an oil flow rate on a lowering side, a lowering electromagnetic pilot valve 50 for controlling pilot pressure relative to the lowering proportional valve 49, a shuttle valve 51 for switching over the oil flow used in operating the lowering proportional valve 49, a check valve 52 for checking a backflow from the right and left elevation cylinders 42 to the raising proportional valve 47, and a compensator 53 for controlling oil pressure, etc.

As shown in FIGS. 5 to 8, the ECU 20 is loaded with an elevation control unit 20B acting as a control program for controlling the operation of the elevation actuating device 40. The elevation control unit 20B performs height control for positioning the work implement to a level corresponding to an operational position of a height setting lever 54, based on an output from a lever sensor 55 for detecting the operational position of the height setting lever 54 as a control target height. The elevation control unit 20B also performs raising control for automatically raising the work implement up to an upper limit position in preference to the height control when an operation of an elevation instructing lever 56 toward a raised position is detected, based on an output from a lever sensor 57 for detecting the operation of the elevation instructing lever 56 from a neutral position to the raised position or a lowered position.

In the height control, the elevation control unit 20B is designed to control the operation of the vertical movement electromagnetic proportional control valve 44 provided in the elevation actuating device 40 so that a swing angle of the lift arms 41 corresponds to an operational position of the height setting lever 54, based on an output from the lever sensor 55 for the height setting lever 54 and an output from an arm sensor 58 for detecting the swing angle of the lift arms 41 as a height of the work implement.

In the raising control, the elevation control unit 20B is designed to control the operation of the vertical movement electromagnetic proportional control valve 44 provided in the elevation actuating device 40 so that the swing angle of the lift arms 41 corresponds to a pivotal operational amount of an upper limit setting device 59 from a reference position, based on an output from the upper limit setting device 59 for outputting the pivotal operational amount from the reference position as a control target upper limit position for the work implement and an output from the arm sensor 58 for the lift arms. Then, when an operation of the elevation instructing lever 56 toward a lowered position is detected based on the output from the lever sensor 57 for the elevation instructing lever, the priority of the raising control is cancelled to perform the height control instead.

More particularly, the height of the work implement can be changed by operating the height setting lever 54 to a desired height corresponding to the operational position of the height setting lever 54. Also, the height of the work implement can be changed to the upper limit position determined by the upper limit setting device 59 by oscillating the elevation instructing lever 56 to the raised position. Further, the height of the work implement can be returned to the designed height corresponding to the operational position of the height setting lever 54 by oscillating the elevation instructing lever 56 to the lowered position.

The height setting lever 54 is provided in the driver's section 6 to be oscillatable fore and aft to be held in position. The elevation instructing lever 56 is provided in the driver's section 6 to be vertically oscillatable to be returned to the neutral position. Respective rotary potentiometers are used for the lever sensor 55 for the height setting lever, and for the arm sensor 58 for the lift arms. The lever sensor 57 for the elevation instructing lever consists of a microswitch for detecting a raising operation and a further microswitch for detecting a lowering operation. The upper limit setting device 59 is provided in the driver's section 6 to be operable with a dial including a rotary potentiometer.

As shown in FIGS. 1 to 3 and FIGS. 5 to 8, the tractor includes a rolling actuating device 60 for oscillatably actuating the work implement in a rolling direction, such as a rotary tiller or a ploughing and irrigating device which is connected to the rear portion of the tractor through the link mechanism 32. The rolling actuating device 60 is a hydraulic type device including a turnbuckle-type relay rod 61 for connecting the left lower link 34 of the link mechanism 32 to the left lift arm 41, a rolling cylinder (an example of the hydraulically operated device) 62 for connecting the right link 34 of the link mechanism 32 to the right lift arm 41, a rolling control valve unit 63 for controlling an oil flow relative to the rolling cylinder 62 to change the length of the rolling cylinder 62 relative to the relay rod 61, etc. A double-acting hydraulic cylinder is used for the rolling cylinder 62.

Figure 10:
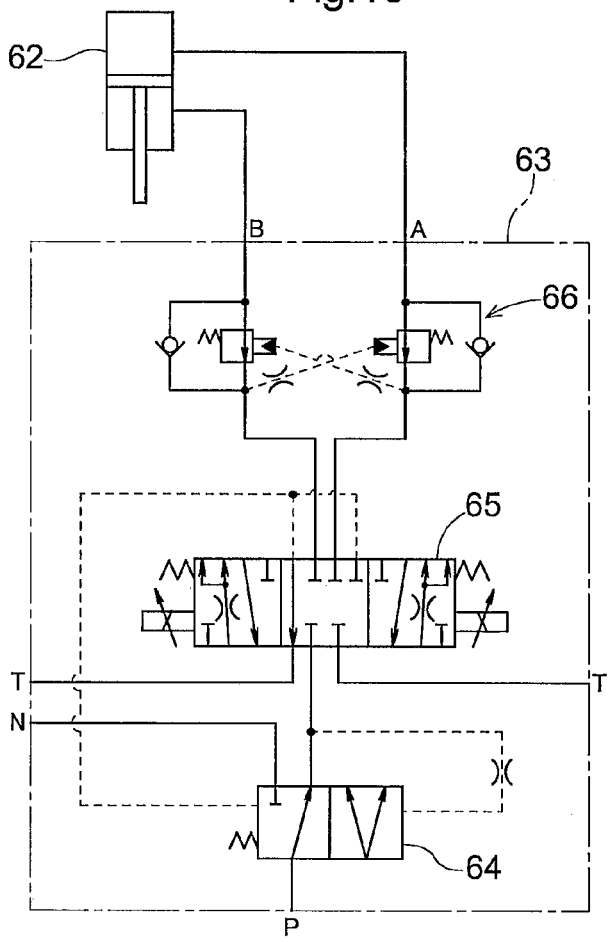
FIG. 10 is a hydraulic circuit showing architecture of a rolling control valve unit.

As shown in FIG. 10, the rolling control valve unit 63 includes a pilot-operated preferential flow-dividing valve 64, a rolling electromagnetic proportional control valve 65, a double-check valve 66 forming a counterbalance circuit, etc. When the rolling of the work implement is actuated, the preferential flow-dividing valve 64 is adjusted in opening degree to provide a proper flow-dividing ratio based on pilot pressure at the rolling control valve unit 63, thereby to supply a necessary amount of oil to the rolling control valve unit 63 preferentially over the elevation control valve unit 43. A direct acting type valve is employed for the rolling electromagnetic proportional control valve 65.

As shown in FIGS. 5 to 8, the ECU 20 is loaded with a rolling control unit 20C as a control program for controlling the operation of the rolling actuating device 60. In response to a switching instruction outputted from a rolling control selection switch 67 provided in the driver's section 6, the rolling control unit 20C is switchable between a state for performing rolling control for horizontal ground for maintaining the work implement in a desired rolling angle on a horizontal agricultural field, and a state for performing rolling control for sloping ground for maintaining the work implement in a desired rolling angle in a running working operation along a contour line on a sloping agricultural field.

In the rolling control for horizontal ground, a control target rolling angle of the work implement relative to the tractor required for maintaining a ground rolling angle of the work implement at a control target rolling angle determined by a rolling angle setting device 68 is calculated, based on an output from the rolling angle setting device 68 provided in the driver's section 6 and an output from a rolling sensor 69 for detecting a rolling angle of the tractor. Then, the operation of the rolling electromagnetic proportional control valve 65 provided in the rolling actuating device 60 is controlled so that the length of the rolling cylinder 62 corresponds to the control target rolling angle of the work implement relative to the tractor, based on the calculated control target rolling angle, an output from a stroke sensor 70 for detecting the length of the rolling cylinder 62, and rolling control correlation data which correlates the length of the rolling cylinder 62 to the control target rolling angle of the work implement relative to the tractor.

Thus, in the running working operation in the horizontal agricultural field, the ground rolling angle of the work implement is maintained at the control target rolling angle determined by the rolling angle setting device 68, regardless of the rolling of the tractor.

In the rolling control for sloping ground, the control target rolling angle of the work implement outputted from the rolling angle setting device 68 is corrected based on a correction value determined by taking into account of a sunk and/or depressed amount each one of the front wheel 1 and the rear wheel 2 that is positioned on the trough side, while performing control operations similar to the rolling control for horizontal ground.

Thus, in the running working operation for propelling the tractor along the contour line on the sloping agricultural field, preferable rolling control can be performed by taking into account of the sunk and/or depressed amount of the wheels 1 and 2 that is positioned on the trough side. As a result, in the running working operation on the sloping agricultural field as well, the ground rolling angle of the work implement can be maintained at the control target rolling angle determined by the rolling angle setting device 68, regardless of the rolling of the tractor.

A momentary switch is used for the rolling control selection switch 67. The rolling angle setting device 68 is operable with a dial including a rotary potentiometer. The rolling sensor 69 consists of a capacitance-type inclination sensor and a vibration-type angular velocity sensor. The stroke sensor 70 uses a slide-type potentiometer.

As shown in FIGS. 2 and 3, the tractor includes an auxiliary hydraulic unit 71 for allowing use of a hydraulically operated device provided in the work implement such as a reversible plough connected to the rear portion of the tractor through the link mechanism 32 (the hydraulically operated device is a reversed cylinder if the work implement is the reversible plough). The auxiliary hydraulic unit 71 includes a bleed-off circuit type, variable preferential flow-dividing valve 72 for supplying a necessary amount of oil to the auxiliary hydraulic unit 71 preferentially over the rolling control valve unit 63 when operating the hydraulically operated device provided in the work implement; a first control valve unit (an example of the hydraulic unit) 73 and a second control valve unit (an example of the hydraulic unit) 74 both having a load sensing function; a relief valve 75, etc. Each of the control valve units 73, 74 comprises a closed load-sensing type unit for properly adjusting or regulating a preferential oil flow rate of the variable preferential flow-dividing valve 72 by load-sensing pressure of each of the control valve units 73, 74; and includes: closed-center type, pilot-operated electromagnetic proportional control valves 76, 77; pressure compensation valves 78, 79; check valves 80, 81; load-sensing shuttle valves 82, 83, etc.

As shown in FIGS. 5 to 8, the ECU 20 is loaded with an auxiliary hydraulic control unit 20D as a control program for controlling the operation of the auxiliary hydraulic unit 71. Based on an output from a lever sensor 85 for detecting the operational position of a first auxiliary lever 84 provided in the driver's section 6, the auxiliary hydraulic control unit 20D is designed to perform first auxiliary control for actuating the electromagnetic proportional control valve 76 provided in the first control valve unit 73 so that the hydraulically operated device of the work implement connected to the first control valve unit 73 executes an operation corresponding to an operational position of a first auxiliary lever 84. Further, based on an output from a lever sensor 87 for detecting the operational position of the second auxiliary lever 86 provided in the driver's section 6, the auxiliary hydraulic control unit 20D performs second auxiliary control for actuating the electromagnetic proportional control valve 77 provided in the second control valve unit 74 so that the hydraulically operated device of the work implement connected to the second control valve unit 74 executes an operation corresponding to an operational position of a second auxiliary lever 86.

Each of the first auxiliary lever 84 and the second auxiliary lever 86 is switchable to be held in three positions. Each of the lever sensor 85 for the first auxiliary lever and the lever sensor 87 for the second auxiliary lever consists of two microswitches for detecting two positions other than the neutral position.

As shown in FIGS. 2 and 3, an axial plunger type variable displacement pump 88 is configured to supply oil to the power steering device 8, front wheel suspension device 9, hydraulic unit for the forward/backward drive switching device 11, hydraulic unit for the main change speed device 12, hydraulic unit for the front wheel change speed device 14, locking differential mechanism for the front wheel differential 15, locking differential mechanism for the rear wheel differential 16, implement work clutch 17, elevation actuating device 40, rolling actuating device 60 and auxiliary hydraulic unit 71. The variable displacement pump 88 is actuated by drive power from the engine 3 to pneumatically feed oil reserved in the transmission case 10.

Oil from the variable displacement pump 88 is supplied to a preferential hydraulic oil section A and a non-preferential hydraulic oil section B through a preferential flow-dividing valve 89. The preferential hydraulic oil section A includes the power steering device 8, front wheel suspension device 9, hydraulic unit for the forward/backward drive switching device 11, hydraulic unit for the main change speed device 12, hydraulic unit for the front wheel change speed device 14, locking differential mechanism for the front wheel differential 15, locking differential mechanism for the rear wheel differential 16 and implement work clutch 17. The auxiliary hydraulic unit 71 includes the elevation actuating device 40, rolling actuating device 60 and auxiliary hydraulic unit 71. The preferential flow-dividing valve 89 is configured to preferentially allocate a fixed amount of oil required at the preferential hydraulic oil section A to the preferential hydraulic oil section A. The preferential flow-dividing valve 89 is also configured to allocate a surplus flow of oil of the fixed amount of oil to the non-preferential hydraulic oil section B.

In the preferential hydraulic oil section A, the fixed amount of oil supplied to the preferential hydraulic oil section A is distributed to two lines as follows. On one hand, oil is supplied preferentially to the power steering device 8 through a pressure regulation valve 90 and a preferential flow-dividing valve 91, while the surplus oil flow is supplied for lubrication to the hydraulic clutches of the forward/backward drive switching device 11 and main change speed device 12. On the other hand, oil is supplied through a pressure reduction valve 92 to the front wheel suspension device 9, hydraulic unit for the forward/backward drive switching device 11, hydraulic unit for the main change speed device 12, hydraulic unit for the front wheel change speed device 14, locking differential mechanism for the front wheel differential 15, locking differential mechanism for the rear wheel differential 16 and implement work clutch 17.

In the non-preferential hydraulic oil section B, the surplus oil flow from the preferential flow-dividing valve 89 is preferentially supplied to the auxiliary hydraulic unit 71 by adjusting the opening degree of the variable preferential flow-dividing valve 72 to provide a proper flow-dividing ratio based on the load-sensing pressure at each of the control valve units 73, 74 of the auxiliary hydraulic unit 71. A surplus oil flow thereof from the variable preferential flow-dividing valve 72 is preferentially supplied to the rolling control valve unit 63 by the preferential flow-dividing valve 64, and a surplus oil flow thereof from the preferential flow-dividing valve 64 is in turn supplied to the elevation control valve unit 43.

As shown in FIGS. 5 to 8, the ECU 20 is loaded with a discharge control unit 20E as a control program for varying a swash plate angle of the variable displacement pump 88 to regulate a discharge rate of the variable displacement pump 88. The discharge control unit 20E includes a necessary flow rate calculating module 20Ea for calculating an oil flow rate required in this hydraulic system, a target operational amount setting module 20Eb for determining a control target operational amount of an electric cylinder (an example of an actuator) 93 for regulating the discharge rate of the variable displacement pump 88 by varying the swash plate angle of the variable displacement pump 88, and an operation control module 20Ec for controlling the operation of the electric cylinder 93.

The necessary flow rate calculating module 20Ea is configured to calculate the oil flow rate required in this hydraulic system based on a preferential flow rate of the preferential flow-dividing valve 89 supplied oil to the preferential hydraulic oil section A and an amount of current distributed to each of the electromagnetic proportional control valves 44, 65, 76, and 77 of the non-preferential hydraulic oil section B.

Figure 8:
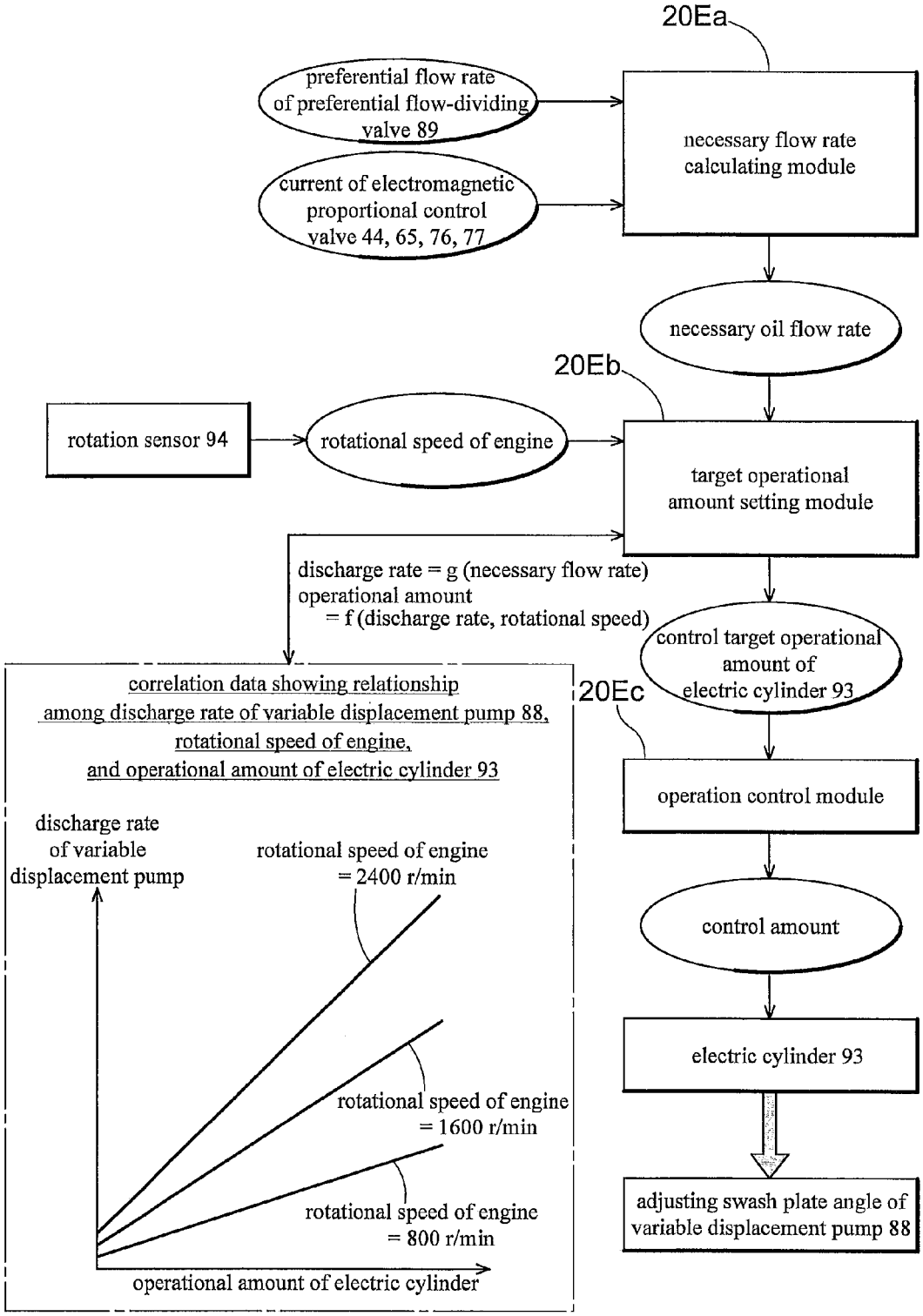
FIG. 8 is a view explaining part of the control system of the tractor.

The target operational amount setting module 20Eb includes a correlation table as the correlation data showing relationship among the discharge rate of the variable displacement pump 88, a rotational speed of the engine and an operational amount of the electric cylinder 93. As shown in FIG. 8, the correlation table stores a plurality of graphs, each graph showing the relationship between the discharge rate of the variable displacement pump 88 and the operational amount of the electric cylinder 93, with the rotational speed of the engine being represented as a parameter. More particularly, each graph represents a function table in which the rotational speed of the engine and the discharge rate are input values while the operational amount is an output value. Thus, with the table as described above, the target operational amount setting module 20Eb is capable of providing the control target operational amount of the electric cylinder 93 for obtaining the necessary flow rate of oil calculated at the flow rate calculation module 20Ea from the necessary flow rate of oil calculated at the flow rate calculation module 20Ea and an output from a rotary sensor 94 for detecting the rotational speed of the engine. The provided control target operational amount is determined as a control target of the electric cylinder 93. The target operational amount setting module 20Eb also performs first correction control and second correction control for correcting the control target operational amount of the electric cylinder 93. In the first correction control, a volume efficiency of the variable displacement pump 88 is obtained based on an output from an oil temperature sensor 95 for detecting a temperature of oil reserved in the transmission case 10 and an output from a first pressure sensor 96 for detecting discharge pressure of the variable displacement pump 88, and based on the obtained volume efficiency, the control target operation amount of the electric cylinder 93 is corrected. In the second correction control, the control target operational amount of the electric cylinder 93 is corrected to allow the pressure of oil, supplied to the elevation actuating device 40, to reach a predetermined pressure based on an output from a second pressure sensor (an example of oil pressure detecting module) 97 which detects the pressure of oil supplied to the elevation actuating device 40.

The operation control module 20Ec is configured to control the operation of the electric cylinder 93 so that the operational amount of the electric cylinder 93 reaches the control target operational amount of the electric cylinder 93 determined at the target operational amount setting module 20Eb (so that the swash plate angle of the variable displacement pump 88 becomes a swash plate angle suitable for achieving the necessary flow rate).

The variable displacement pump 88 mechanically limits the minimum swash plate angle so as to secure the fixed amount of oil supplied to the preferential hydraulic oil section A, even when the rotational speed of the engine is lowered to the idling speed.

In the above-noted arrangement, when none of the elevation actuating device 40, the rolling actuating device 60 and auxiliary hydraulic unit 71 are actuated, the discharge control unit 20E is designed to vary the swash plate angle of the variable displacement pump 88 so that the fixed amount of oil supplied to the preferential hydraulic oil section A and an amount of oil required for the output from the second pressure sensor 97 to reach the predetermined pressure are obtained.

When only the elevation actuating device 40 is actuated, the swash plate angle of the variable displacement pump 88 is varied so that the fixed amount of oil supplied to the preferential hydraulic oil section A and an amount of oil required to actuate the elevation actuating device 40 are obtained.

When only the rolling actuating device 60 is actuated, the swash plate angle of the variable displacement pump 88 is varied so that the fixed amount of oil supplied to the preferential hydraulic oil section A, an amount of oil required to actuate the rolling actuating device 60 and the amount of oil required for the output from the second pressure sensor 97 to reach the predetermined pressure are obtained.

When only the auxiliary hydraulic unit 71 is actuated, the swash plate angle of the variable displacement pump 88 is varied so that the fixed amount of oil supplied to the preferential hydraulic oil section A, an amount of oil required to actuate the auxiliary hydraulic unit 71 and the amount of oil required for the output from the second pressure sensor 97 to reach the predetermined pressure are obtained.

When the elevation actuating device 40 and the rolling actuating device 60 are actuated, the swash plate angle of the variable displacement pump 88 is varied so that the fixed amount of oil supplied to the preferential hydraulic oil section A, the amount of oil required to actuate the elevation actuating device 40 and the amount of oil required to actuate the rolling actuating device 60 are obtained. In this case, it is possible to properly distribute a necessary flow rate of oil to each of the elevation actuating device 40 and rolling actuating device 60 from the surplus oil flow of the preferential flow-dividing valve 89 under the respective actions of the preferential flow-dividing valve 64 and the variable preferential flow-dividing valve 72.

When the elevation actuating device 40 and the auxiliary hydraulic unit 71 are actuated, the swash plate angle of the variable displacement pump 88 is varied so that the fixed amount of oil supplied to the preferential hydraulic oil section A, the amount of oil required to actuate the elevation actuating device 40 and the amount of oil required to actuate the auxiliary hydraulic unit 71 are obtained. In this case, it is possible to properly distribute a necessary flow rate of oil to each of the elevation actuating device 40 and auxiliary hydraulic unit 71 from the surplus oil flow of the preferential flow-dividing valve 89 under the respective actions of the preferential flow-dividing valve 64 and the variable preferential flow-dividing valve 72.

When the rolling actuating device 60 and the auxiliary hydraulic unit 71 are actuated, the swash plate angle of the variable displacement pump 88 is varied so that the fixed amount of oil supplied to the preferential hydraulic oil section A, the amount of oil required to actuate the rolling actuating device 60, the amount of oil required to actuate the auxiliary hydraulic unit 71 and the amount of oil required for the output from the second pressure sensor 97 to reach the predetermined pressure are obtained. In this case, it is possible to properly distribute a necessary flow rate of oil to each of the rolling actuating device 60 and auxiliary hydraulic unit 71 from the surplus oil flow of the preferential flow-dividing valve 89 under the respective actions of the preferential flow-dividing valve 64 and the variable preferential flow-dividing valve 72.

When the elevation actuating device 40, the rolling actuating device 60 and the auxiliary hydraulic unit 71 are actuated, the swash plate angle of the variable displacement pump 88 is varied so that the fixed amount of oil supplied to the preferential hydraulic oil section A, the amount of oil required to actuate the elevation actuating device 40, the amount of oil required to actuate the rolling actuating device 60 and the amount of oil required to actuate the auxiliary hydraulic unit 71 are obtained. In this case, it is possible to properly distribute a necessary flow rate of oil to each of the elevation actuating device 40, the rolling actuating device 60 and auxiliary hydraulic unit 71 from the surplus oil flow of the preferential flow-dividing valve 89 under the respective actions of the preferential flow-dividing valve 64 and the variable preferential flow-dividing valve 72.

Also, when the first control valve unit 73 and the second control valve unit 74 of the auxiliary hydraulic unit 71 are concurrently actuated, it is possible to properly distribute a necessary flow rate of oil to each of the first control valve unit 73 and the second control valve unit 74 from the surplus oil flow of the preferential flow-dividing valve 89 under the action of the variable preferential flow-dividing valve 72.

Further, when the necessary flow rate of oil is no longer securable with the control of the swash plate of the variable displacement pump 88 because of a drastic fall in rotational speed of the engine, it is possible to distribute the surplus oil flow from the preferential flow-dividing valve 89, after having supplied the fixed amount of oil to the preferential hydraulic oil section A, to the actuated one(s) of the elevation actuating device 40, rolling actuating device 60 and auxiliary hydraulic unit 71 under the respective actions of the preferential flow-dividing valve 64 and the variable preferential flow-dividing valve 72 with a proper flow-dividing ratio suitable for the actuated device(s).

More particularly, the fixed amount of oil required at the preferential hydraulic oil section A can be reliably secured regardless of the rotational speed of the engine, and thus a necessary amount of oil can be reliably supplied to the power steering device 8 and the transmission line such as the forward/backward drive switching device 11 and the main change speed device 12. As a result, it is possible to avoid disadvantages that the steering operation becomes difficult due to shortage of oil supplied to the power steering device 8 and that power is inadvertently cut off due to shortage of oil supplied to the transmission line such as the forward/backward drive switching device 11 and the main change speed device 12, etc.

In addition, the necessary amount of oil can be supplied to each of the elevation actuating device 40, rolling actuating device 60 and auxiliary hydraulic unit 71 neither too much nor too little unless the rotational speed of the engine drastically drops. This allows the vertical movement of the work implement, the rolling actuation of the work implement and the actuation of the hydraulically operated devices provided in the work implement while saving energy.

Moreover, when the rotational speed of the engine drastically drops and the necessary flow rate of oil to be supplied to each of the elevation actuating device 40, rolling actuating device 60 and auxiliary hydraulic unit 71 is no longer securable, it is possible to distribute the surplus oil flow from the preferential flow-dividing valve 89 to the actuated one(s) of the elevation actuating device 40, rolling actuating device 60 and auxiliary hydraulic unit 71 with a proper flow-dividing ratio suitable for the actuated device(s). As a result, the elevation actuating device 40, rolling actuating device 60 and auxiliary hydraulic unit 71 can be concurrently actuated even when the necessary flow rate of oil is no longer securable.

Then, the minimum swash plate angle of the variable displacement pump 88 is mechanically limited, thereby to avoid a disadvantage that the minimum swash plate angle of the variable displacement pump 88 cannot be secured because of disconnection or breaking that might occur when electrically limited.

To a front portion of the tractor can be connected a front loader (not shown) as an example of the work implement. When the front loader is connected, a front loader auxiliary hydraulic unit 98 (an example of the hydraulic unit) [see FIG. 2] can be additionally provided in a connecting end of the existing auxiliary hydraulic unit 71.

Figure 11:
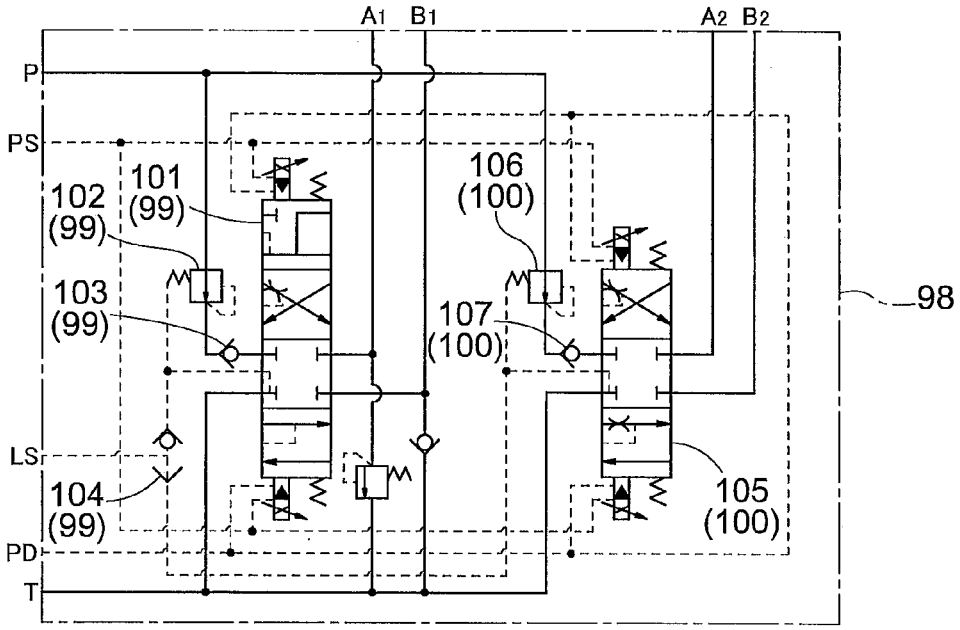
FIG. 11 is a hydraulic circuit showing architecture of an auxiliary hydraulic unit for a front loader.

As shown in FIG. 11, the front loader auxiliary hydraulic unit 98 includes a boom-operating control valve unit 99 and a bucket-operating control valve unit 100, both having a load sensing function. The boom-operating control valve unit 99 includes a closed-center type, pilot-operated electromagnetic proportional control valve 101, a pressure compensation valve 102, a check valve 103, a load-sensing shuttle valve 104, etc. The bucket-operating control valve unit 100 includes a closed-center type, pilot-operated electromagnetic proportional control valve 105, a pressure compensated valve 106 and a check valve 107. Each of the boom-operating control valve unit 99 and bucket-operating control valve unit 100 is formed as a closed load-sensing type unit for properly regulating the preferential oil flow rate of the variable preferential flow-dividing valve 72 by the load-sensing pressure of each of the control valve units 99, 100.

With the front loader auxiliary hydraulic unit 98 being connected to the connecting end of the auxiliary hydraulic unit 71, it is possible to connect a corresponding pump oil passage, a pilot oil passage, a load-sensing oil passage and a tank oil passage in each of those auxiliary hydraulic units 71, 98. When the front loader auxiliary hydraulic unit 98 is provided on a front side of the vehicle closer to the front loader, the auxiliary hydraulic unit 71 and the front loader auxiliary hydraulic unit 98 can be connected to each other through a hydraulic hose, for example.

As shown in FIGS. 5 to 8, the ECU 20 is additionally loaded with a front loader auxiliary hydraulic control unit 20F for controlling the operation of the front loader auxiliary hydraulic unit 98 as a control program. The front loader auxiliary hydraulic control unit 20F is designed to perform boom actuating control for actuating the electromagnetic proportional control valve 101 provided in the boom-operating control valve unit 99 so that a boom cylinder (an example of the hydraulically operated device) 110 connected to the boom-operating control valve unit 99 is extended or contracted in response to the operation of a boom control lever 108, based on an output from a lever sensor 109 for detecting an operational position of the boom control lever 108 additionally provided in the driver's section 6. Further, the auxiliary hydraulic control unit 20F is configured to perform bucket actuating control for actuating the electromagnetic proportional control valve 105 provided in the bucket-operating control valve unit 100 so that a bucket cylinder (an example of the hydraulically operated device) 113 connected to the bucket-operating control valve unit 100 is extended or contracted in response to the operation of a bucket control lever 111, based on an output from a lever sensor 112 for detecting an operational position of the bucket control lever 111 additionally provided in the driver's section 6.

Each of the boom control lever 108 and the bucket control lever 111 is oscillatable fore and aft to be returned to the neutral position. Rotary potentiometers are used for the boom lever sensor 109 and the bucket lever sensor 112.

Since the front loader auxiliary hydraulic unit 98 belongs to the non-preferential hydraulic oil section B, when the front loader is connected, the flow rate calculating module 20Ea calculates a necessary oil flow rate required in this hydraulic system, based on the preferential oil flow rate of the preferential flow-dividing valve 89 supplied to the preferential hydraulic oil section A and an amount of current distributed to each of the electromagnetic proportional valves 44, 65, 76, 77, 101, 102 in the non-preferential hydraulic oil section B. Then, each of the target operational amount setting module 20Eb and the operation control module 20Ec perform the control as described above.

With the above-noted arrangement, when the front loader auxiliary hydraulic unit 98 is actuated as well, the fixed amount of oil required in the preferential hydraulic oil section A can be reliably secured regardless of the rotational speed of the engine. As a result, a necessary flow rate of oil can be reliably supplied to each of the power steering device 8, and the transmission line such as the forward/backward drive switching device 11 and the main change speed device 12.

Further, it is possible to supply a necessary flow rate of oil to each of the elevation actuating device 40, the rolling actuating device 60, the auxiliary hydraulic unit 71 and the front loader auxiliary hydraulic unit 98 neither too much nor too little unless the rotational speed of the engine drastically drops. This allows proper control such as the vertical movement the work implement connected to the rear portion of the tractor, the rolling of the work implement connected to the rear portion of the tractor, the operation of the hydraulically operated device of the work implement connected to the rear portion of the tractor and the operation of the front loader, while saving energy.

Moreover, when the rotational speed of the engine drastically drops and the necessary flow rate of oil cannot be secured for each of the elevation actuating device 40, the rolling actuating device 60, the auxiliary hydraulic unit 71 and the front loader auxiliary hydraulic unit 98, it is possible to distribute the surplus oil flow from the preferential flow-dividing valve 89 to the actuated one(s) of the elevation actuating device 40, rolling actuating device 60, auxiliary hydraulic unit 71 and front loader auxiliary hydraulic unit 98 with a proper flow-dividing ratio suitable for the actuated device(s). As a result, the elevation actuating device 40, rolling actuating device 60, auxiliary hydraulic unit 71 and the front loader auxiliary hydraulic unit 98 can be concurrently actuated even when the necessary flow rate of oil is no longer securable.

When the boom control valve unit 99 and the bucket control valve unit 100 provided in the front loader auxiliary hydraulic unit 98 are concurrently actuated, a necessary flow rate of oil is properly distributed to each of the boom control valve unit 99 and the bucket control valve unit 100 from the surplus oil flow of the preferential flow-dividing valve 89 under the action of the variable preferential flow-dividing valve 72.

Modified Embodiments

[1] A non-equilibrium type vane pump or variable displacement vane pump may be employed as the variable displacement pump 88.

[2] The hydraulically operated devices provided in the preferential hydraulic oil section A and the hydraulically operated device provided in the non-preferential hydraulic oil section B may be variously changed. For instance, the hydraulically operated device provided in the preferential hydraulic oil section A may be a hydrostatic stepless change speed device or an integral-type power steering device. On the other hand, the hydraulically operated device provided in the non-preferential hydraulic oil section B may be a hydraulic motor for rotatably actuating a rotary member such as a hydraulically-operated rotary blade provided in the work implement such as a mower.

[3] It is possible to set priorities of oil supply among all of the electromagnetic proportional control valves 44, 65, 76, 77, 101 and 105 provided in the non-preferential hydraulic oil section B and arrange the preferential flow-dividing valves 64 and 72 between the electromagnetic proportional control valve of a higher priority and the electromagnetic proportional control valve of a lower priority.

[4] When the closed load-sensing type hydraulic units 73, 74, 98 are not provided, either one of the closed-center type and the open-center type hydraulic units may be employed each as the electromagnetic proportional control valves 44, 65, 76, 77, 101, 105.

[5] An electric motor or a hydraulic cylinder may be employed as the actuator instead of the electric cylinder 93 for varying the swash plate angle of the variable displacement pump 88.

[6] A pressure switch may be employed as the oil pressure detecting module instead of the pressure sensor 97.

[7] The construction of the preferential flow-dividing valve 64, 72 or 89 may be variously changed, and is not limited to the arrangement as shown and described such as one provided with a throttle valve, for securing a predetermined amount of preferential divided oil flow rate. For instance, the arrangement for securing the predetermined amount of preferential divided oil flow rate may be provided by a relief valve or differential pressure.

[8] The construction of the variable preferential flow-dividing valve 72 may be variously changed, and is not limited to the arrangement as shown and described, for regulating the preferential oil flow rate. Instead of the arrangement for regulating the preferential oil flow rate by differential pressure between pressure in the upstream side of the variable preferential flow-dividing valve 72 and the load-sensing pressure of the hydraulic units 73, 74 or 98, the arrangement for regulating the preferential oil flow rate may be provided by pilot-operating a variable aperture, for example.

INDUSTRIAL APPLICABILITY

The hydraulic system for the work vehicle relating to the present invention is applicable to the work vehicle such as a backhoe and a wheel loader including a plurality of hydraulically operated devices.

DESCRIPTION OF REFERENCE SIGNS

3 engine
20 controller
20Ea necessary flow rate calculating module
20Eb target operational amount setting module
20Ec operation control module
42 hydraulically operated device
44 electromagnetic proportional control valve
62 hydraulically operated device
65 electromagnetic proportional control valve
72 preferential flow-dividing valve (variable preferential flow-dividing valve)
73 hydraulic unit
74 hydraulic unit
76 electromagnetic proportional control valve
77 electromagnetic proportional control valve
88 variable displacement pump
89 preferential flow-dividing valve
93 actuator
94 rotation sensor
95 oil temperature sensor
96 pressure sensor
97 oil pressure detecting module
98 hydraulic unit
101 electromagnetic proportional control valve
105 electromagnetic proportional control valve
110 hydraulically operated device
113 hydraulically operated device
A preferential hydraulic oil section
B non-preferential hydraulic oil section

The invention claimed is:

1. A hydraulic system for a work vehicle, comprising:

a variable displacement pump operable with drive power form an engine;

an actuator for regulating a discharge rate of the variable displacement pump; a preferential flow-dividing valve for supplying a fixed amount of oil discharged from the variable displacement pump preferentially to a preferential hydraulic oil section and supplying a surplus oil flow from the pump to a non-preferential hydraulic oil section;

a plurality of electromagnetic proportional control valves provided in the non-preferential hydraulic oil section for controlling oil flows relative to a plurality of hydraulically operated devices included in the non-preferential hydraulic oil section, the plurality of electromagnetic proportional control valves including a high priority electromagnetic proportional control valve and a low priority electromagnetic proportional control valve;

a second preferential flow-dividing valve provided in the non-preferential hydraulic oil section for supplying a preferential oil flow to the high priority electromagnetic proportional control valve, and supplying a surplus oil flow of the preferential oil to the low priority electromagnetic proportional control valve;

a necessary flow rate calculating module for directly calculating a necessary oil flow rate in each of the preferential hydraulic oil section and the non-preferential hydraulic oil section based on a preferential oil flow rate of the preferential flow-dividing valve supplied oil to the preferential hydraulic oil section and an amount of current distributed to each of the plurality of electromagnetic proportional control valves in the non-preferential hydraulic oil section;

correlation data showing relationship among the discharge rate of the variable displacement pump, a rotational speed of the engine and an operational amount of the actuator;

a target operational amount setting module for providing a control target operational amount of the actuator for obtaining the necessary oil flow rate calculated at the necessary flow rate calculating module based on the necessary oil flow rate calculated at the necessary flow rate calculating module, an output from a rotary sensor for detecting the rotational speed of the engine, and the correlation data; and an operation control module for controlling the actuator based on the control target operational amount.

2. The hydraulic system according to in claim 1, wherein the target operational amount setting module is configured to obtain a volume efficiency of the variable displacement pump based on an output from an oil temperature sensor for detecting a temperature of oil and an output from a pressure sensor for detecting discharge pressure of the variable displacement pump, and to correct the control target operational amount of the actuator based on the obtained volume efficiency.

3. The hydraulic system according to in claim 2, further comprising:

an oil pressure detecting module for detecting pressure of oil supplied to a most downstream electromagnetic proportional control valve, wherein the target operational amount setting module is configured to correct the control target operational amount of the actuator to allow the pressure of oil supplied to the most downstream electromagnetic proportional control valve to reach a predetermined pressure based on an output from the oil pressure detecting module.

4. The hydraulic system according to in claim 2, wherein the second preferential flow-dividing valve provided in the non-preferential hydraulic oil section is a variable preferential flow-dividing valve;

a plurality of the high priority electromagnetic proportional control valves are provided in the non-preferential hydraulic oil section, each of the high priority electromagnetic proportional control valves comprises a closed-center type valve, and wherein each of the electromagnetic proportional control valves forms a hydraulic unit which comprises a closed load-sensing type hydraulic unit for regulating the preferential flow rate of the variable preferential flow-dividing valve based on load-sensing pressure.

5. The hydraulic system according to in claim 1, further comprising:

an oil pressure detecting module for detecting pressure of oil supplied to a most downstream electromagnetic proportional control valve, wherein the target operational amount setting module is configured to correct the control target operational amount of the actuator to allow the pressure of oil supplied to the most downstream electromagnetic proportional control valve to reach a predetermined pressure based on an output from the oil pressure detecting module.

6. The hydraulic system according to in claim 5, wherein the second preferential flow-dividing valve provided in the non-preferential hydraulic oil section is a variable preferential flow-dividing valve;

a plurality of the high priority electromagnetic proportional control valves are provided in the non-preferential hydraulic oil section, each of the high priority electromagnetic proportional control valves comprises a closed-center type valve, and wherein each of the electromagnetic proportional control valves forms a hydraulic unit which comprises a closed load-sensing type hydraulic unit for regulating the preferential flow rate of the variable preferential flow-dividing valve based on load-sensing pressure.

7. The hydraulic system according to in claim 1, wherein the second preferential flow-dividing valve provided in the non-preferential hydraulic oil section is a variable preferential flow-dividing valve;

a plurality of the high priority electromagnetic proportional control valves are provided in the non-preferential hydraulic oil section, each of the high priority electromagnetic proportional control valves comprises a closed-center type valve, and wherein each of the electromagnetic proportional control valves forms a hydraulic unit which comprises a closed load-sensing type hydraulic unit for regulating the preferential flow rate of the variable preferential flow-dividing valve based on load-sensing pressure.

* * * * *